United States Patent [19]

Kempa

[11] 4,174,820

[45] Nov. 20, 1979

[54] METHOD FOR MOVING A RAILWAY SWITCH AND EQUIPMENT FOR IMPLEMENTING THE METHOD

[75] Inventor: Bernd-Joachim Kempa, Berlin, Fed. Rep. of Germany

[73] Assignee: Elektro-Thermit GmbH, Fed. Rep. of Germany

[21] Appl. No.: 912,998

[22] Filed: Jun. 6, 1978

[30] Foreign Application Priority Data

Jun. 24, 1977 [DE] Fed. Rep. of Germany ..... 2728413

[51] Int. Cl.[2] ..... E01B 7/04

[52] U.S. Cl. ..... 246/430; 104/130; 246/415 R; 246/443

[58] Field of Search ..... 246/336, 415 R, 430, 246/380, 392, 269, 301, 311, 333-334, 341-342, 347, 377, 434, 442, 445, 446, 453, 406, 317; 104/130, 132

[56] References Cited

U.S. PATENT DOCUMENTS

| | | | |
|---|---|---|---|
| 1,825,415 | 9/1931 | Overmiller | 246/445 |
| 2,641,690 | 6/1953 | McLeish | 246/453 |
| 3,093,090 | 6/1963 | Rosenbaum | 246/434 |

*Primary Examiner*—Reinhard J. Eisenzopf
*Attorney, Agent, or Firm*—James E. Bryan

[57] ABSTRACT

This invention relates to an improvement in an apparatus and method for moving a railway switch composed of travel rail sections of a main track which are pivoted by positioning elements to rail sections of a branch-off track and locked by closing elements in a particular position with respect to a switch plate extending across the switch, the improvement comprising two positioning sleds, a profiled guide rail supporting each of said sleds, one of said guide rails being outside of and parallel to said travel rail sections of said main track, and the other of said guide rails being outside of and parallel to said rail sections of said branch-off track, and a cross-piece on each positioning sled, each of said cross-pieces having a compression roller mounted thereon and adapted to engage the inside of a rail head of an adjacent travel rail.

11 Claims, 4 Drawing Figures

METHOD FOR MOVING A RAILWAY SWITCH AND EQUIPMENT FOR IMPLEMENTING THE METHOD

The invention relates to a method for moving a railway switch composed of rail sections of a main track and being pivoted to a branch track by means of positioning elements and locked by closing elements into its particular switching position with respect to a switch plate passing through the area of the switch.

The efficiency of a rapid transit sector is determined by the rate at which the trains can pass through the sector including the switch. This is particularly the case for the branch region of the switch.

As regards the known tongue switches with fixed stock rails and movable switch rails and large-radius switches required for safety at higher speeds, the tongue tips become extremely long. Such slender tongue tips are costly to make and wear rapidly in view of the high speeds, the high axle loads and the high guidance forces required. Furthermore difficulties are encountered in using previously known equipment to so move these long tongues that the desired large radius is precisely achieved. Both these drawbacks - rapid wear and unevenly curved tongues - may become safety hazards at high speeds and axle loads.

U.S. Pat. Nos. 1,742,947, 2,641,690, and 3,317,725, disclose how to make both rails of the main track movable in the entry region of tongue switches which are desired to have a large radius in their branch track, and how to switch according to the desired direction of travel. This switching is implemented by moving elements pivoting the rail sections horizontally. Such tongue switches have the drawback that a gap corresponding to the tongue position between the end of the tongue and the connecting switch parts remains. Such gaps cause uneven vehicle travel and high maintenance costs.

German Pat. No 2,042,233, discloses a tongue switch so moving the tongues that when in position, the ends of both the tongue and of the continuing rails cannot move relatively to each other even under a vehicle load, whereby a continuous traveling edge is created in the region of the gaps. In this case the free ends of the tongues comprise recesses in the lengthwise direction of the rails, and locking elements are housed in corresponding recesses in the free ends of the connecting rails of the main and the branch tracks, the locking elements being in the form of wedges which in the connecting position are inserted in form-locking manner into these tongue recesses.

German Pat. No. 2,247,729, furthermore discloses the design of a high-speed travel switch with which the rail sections of the main track are moved along their entire lengths with respect to the connecting rails of the branch track. A large number of moving elements is required, implementing the motion of the switch by mechanical, electrical or hydraulic drives. Because of the large number of moving elements required, such a design is very costly and susceptible to difficulties, the failure of a single element already eliminating reliable motion and hence eliminating the procedure.

The present invention therefore addresses the problem of so moving the switch of the main track, composed of travel rails and to be used for high speed traffic, by a reliable and continuous guidance means that it becomes feasible to operate without a multitude of positioning elements.

The invention solves this problem by using two positioning sleds as positioning elements, each of which moves on a profiled guide rail, where one of these guide rails extends outside and parallel to the travel rails of the switch corresponding to the main track and where the other extends outside and parallel to the travel rails of the branch track, the particular sled engaging by a crosspiece the inside surface of the rail head of the travel rail of the movable rail section adjacent to the guide rail, and pulling the rail sections into the desired position when the guide rail moves from the entry to the exit, the sled at the threshold of the entry region being pivoted into the switch position and when leaving the exit region, being pivoted out of it.

This method, in which the moving of the switch is implemented by only one positioning element each, namely the positioning sled, thereby ensured reliable and continuous guidance of the switches. The rail to be moved is guided in a constrained manner by the positioning sled, by the crosspiece and by a compression roller parallel to the profiled guide rails. The reliability of the positioning sled can be easily monitored. It is especially advantageous that only two positioning sleds are required to actuate the switch. When required, the positioning sleds may be overhauled in simple manner. The use of a profiled guide rail corresponding to the desired curve allows easy adaptation of the switches to the shape of such curves.

Because of reliability, the movable rail sections must be locked after they have been moved into the desired position against undesired displacements. Such locking may be implemented by fixing appropriate locking means after the displacement of the positioning sled which moves the rail sections or by loosening the locking means when the sled moves back.

Equipment is provided to implement the method of the invention, in which the particular profiled guide rails are mounted longitudinally outside and parallel to the travel rails, one profiled guide rail being located outside and parallel to the travel rail of the switch corresponding to the main track, and another guide rail being located outside and parallel to the travel rail in the branch-off position, spaced from the rail and rigidly mounted with respect thereto, and in which one positioning sled each is provided that is guided by the profiled guide rails and can be displaced thereon, the positioning sled comprising a crosspiece to which is mounted a compression roller engaging the inside of the rail head of the particular adjacent travel rail of the switch.

In order to provide the switch (movable rail sections) with the prescribed geometry, preferably the guide rails rigidly rest on guide ties which simultaneously support the rail sections designed into a switch.

Appropriately, the guide tie is designed to comprise two profiled, guide rails mutually parallel, and spaced from each other, welded onto a switch plate, between which moves a running wheel locked in formlocking manner with a horizontally movable gliding plate, which in turn is solidly connected to the travel rails. In this manner the forces applied in the lengthwise direction of the travel rails can be shunted in both directions into the foundation. The spacing between the profiled guide rails must be so selected that the running wheel can always roll off one of the two guide rails.

In order to hold the pivoting travel rails absolutely fixed in their particular predetermined position, locking elements preferably are mounted to the profiled guide rails on both sides thereof; such locking elements can pivot into corresponding recesses of the gliding plates, where they are locked. This pivotal locking or unlocking is implemented by an element mounted to the underside of the arm of the crosspiece of the positioning sled.

To impart a form-locking guidance to the positioning sled and hence also a form-locking drive, the guide rails are so made that they include recesses engaged by the drive of the sled and guide elements. To achieve operational reliability despite the large positional reactions that occur, a motor drives the positioning element, by means of a drive element in form-locking connection with the guide rail. The drive elements preferably are gears.

The supply of electrical power being reliable and simple, the drive is effected electrically using a motor tapping its power from an electrical rail which is mounted by means of suitable fasteners to the guide ties.

The invention will be further illustrated by reference to the accompanying drawings, which show a simple switch as an embodiment of the invention, and in which.

Figure 1:
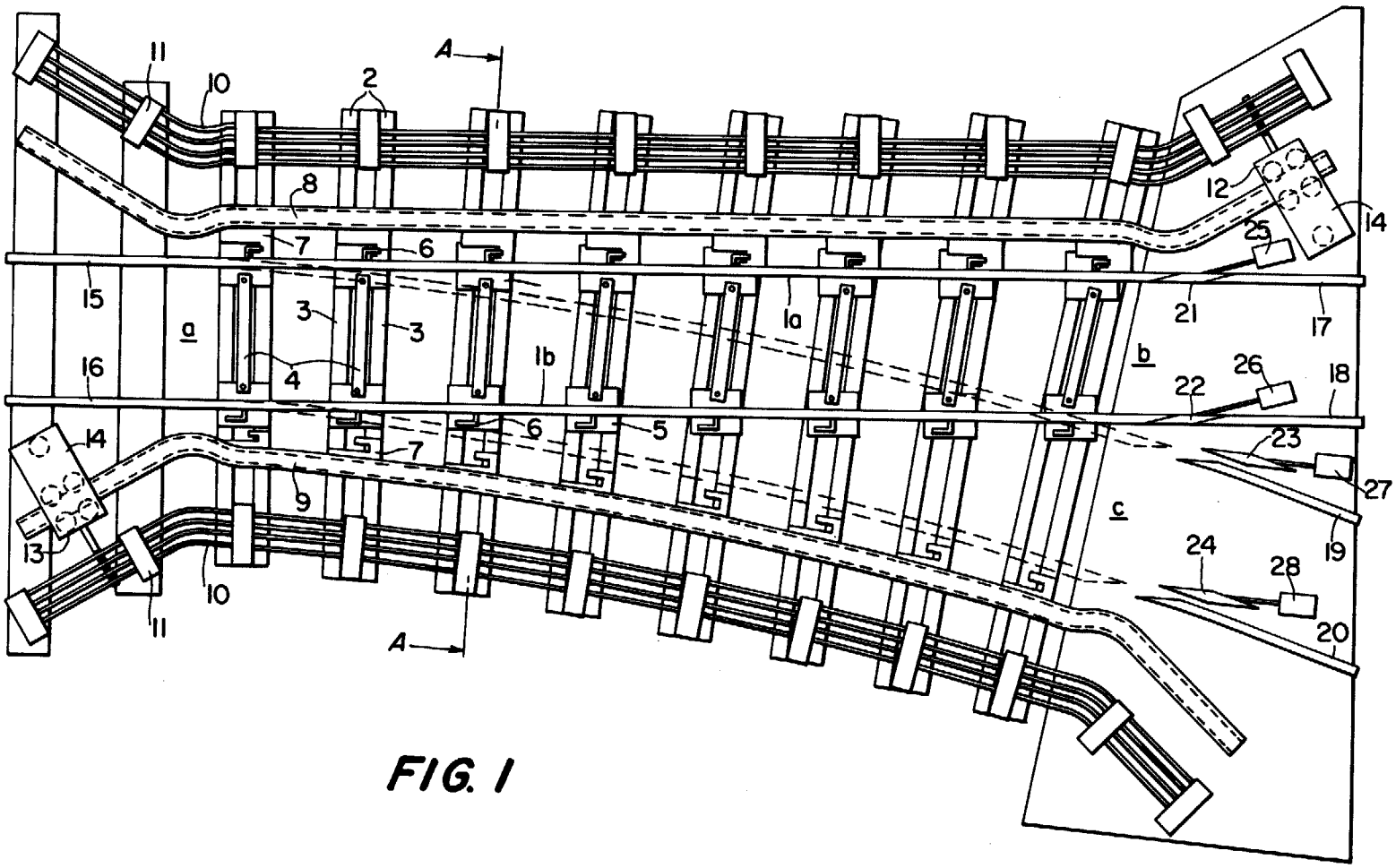
FIG. 1 is a top view of the overall track.
Figure 2:
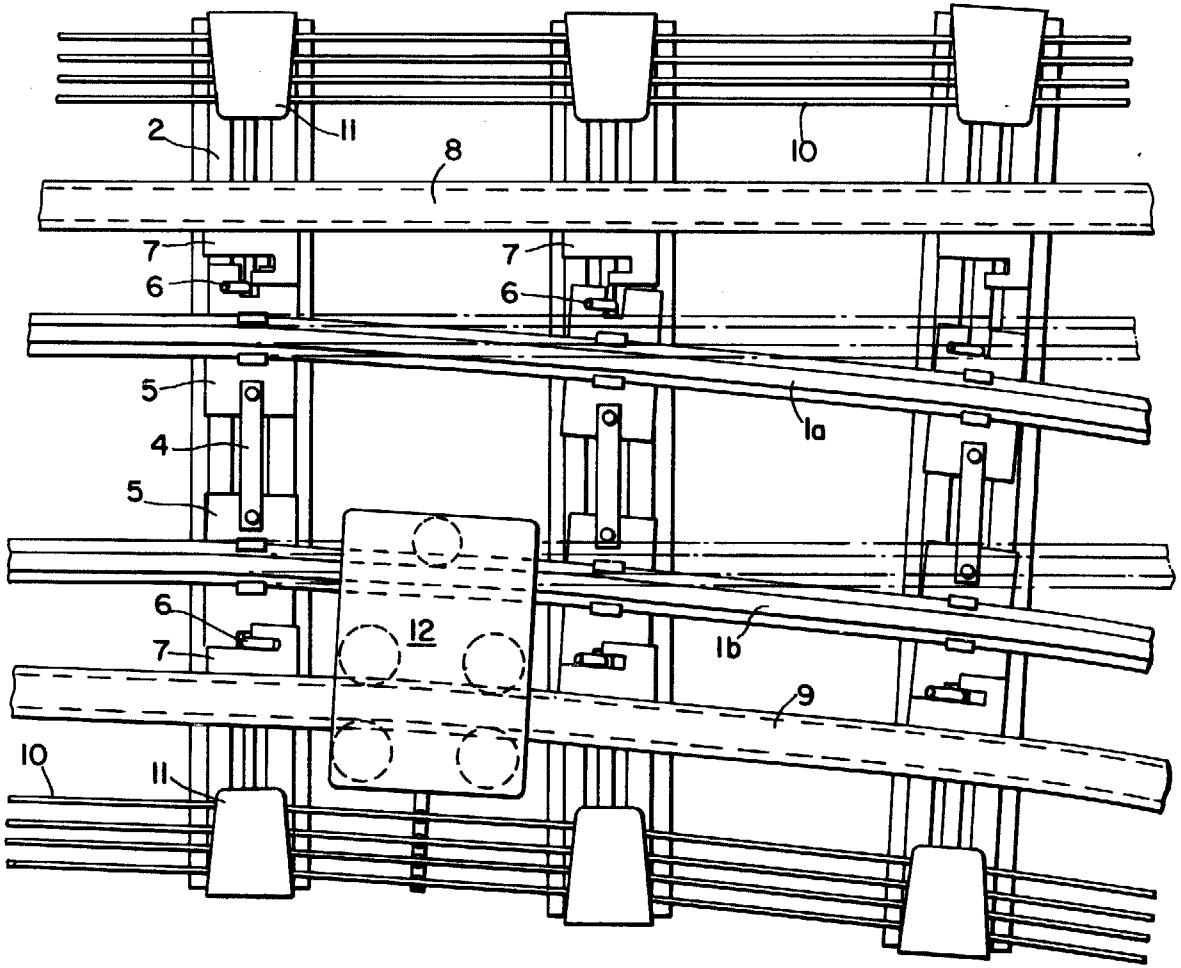
FIG. 2 is a top view on an enlarged scale of a cut-out of FIG. 1.
Figure 3:
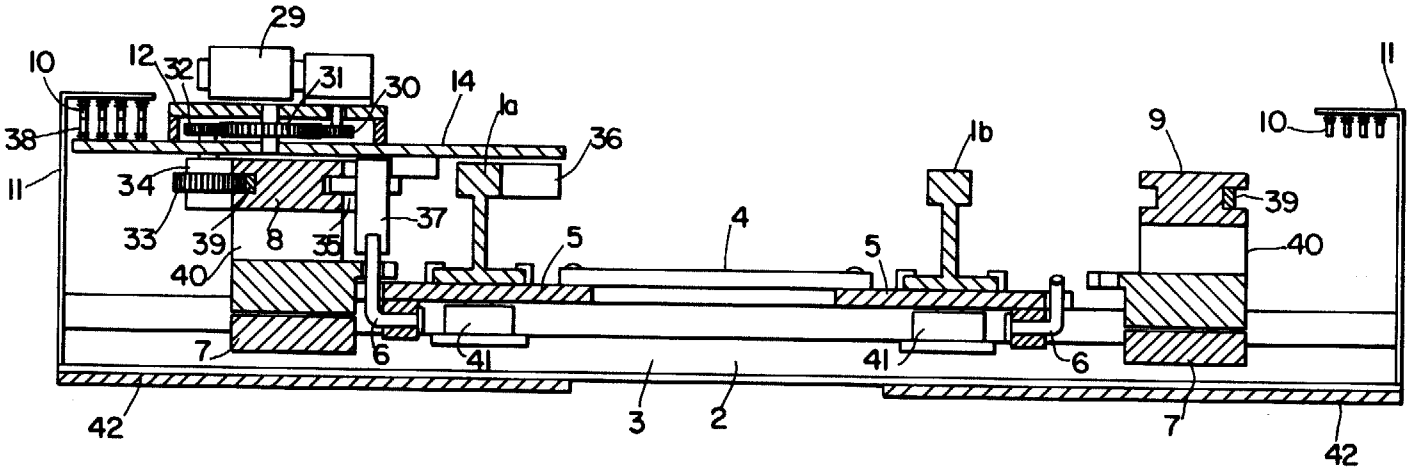
FIG. 3 is the section A—A of FIG. 1.

In FIG. 1, the travel rails 1*a* and 1*b* from a to b lie on the guide ties 2, allowing a tranverse motion of the travel rails 1*a* and 1*b* . The incoming track rails 15 and 16 and the outgoing straight connecting rails 17 and 18 or the outgoing branching connecting rails 19 and 20 are rigidly connected in a conventional manner to the ties. The travel rails 1*a* and 1*b* are joined in gapless manner with the track rails 15 and 16. The joining of the travel rails 1*a* and 1*b* to the straight connecting rails 17 and 18 is implemented by the closing wedges 21 and 22 which in turn are moved into their operational positions by the positioning elements 25 and 26. The joining of the travel rails 1*a* and 1*b* with the connecting rails 19 and 20 is implemented by the closing wedges 23 and 24 which in turn are moved into their operational positions by the positioning elements 27 and 28.

Figure 4:
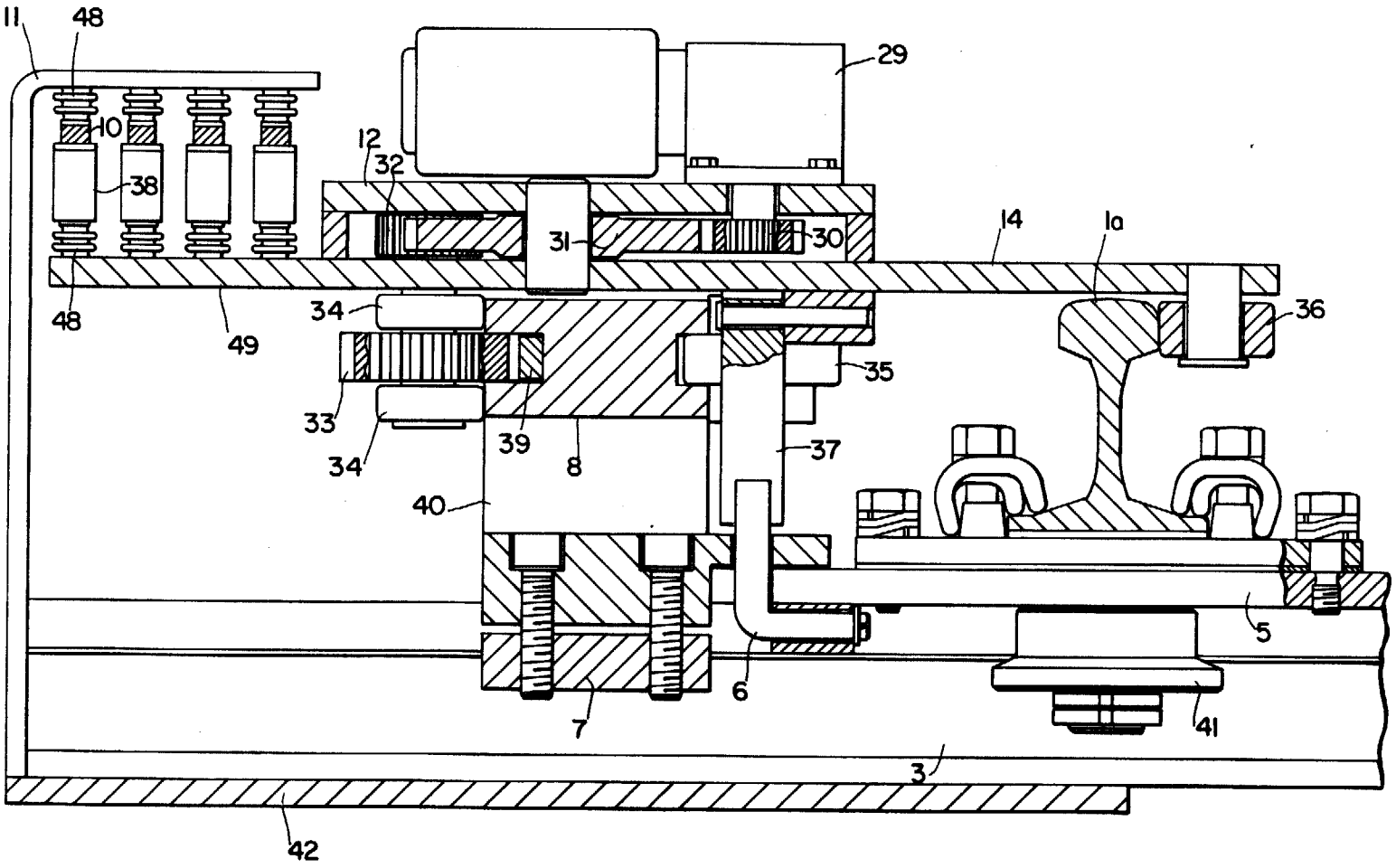
FIG. 4 is an enlarged cut-out of FIG. 3.

The profiled guide rail 8 is located parallel to the travel rails 1*a* and 1*b*, and the profiled guide rail 9 for the branched track is located in the direction of the branching rails 19 and 20. The profiled guide rails 8 and 9 are precisely trued to correspond to the geometry of the switch, and, as shown by FIG. 4, are rigidly mounted by the supports 40 to the limit stops 7. The ends of the profiled guide rails 8 and 9 are so bent that the positioning sleds 12 and 13 assume their rest positions after their movement beyond the track is completed. FIG. 1 shows the positioning sled 12 after its movement from a to b and being in its rest position, and positioning sled 13 after its movement from c to a and being in its rest position. The positioning sleds 12 and 13 are guided by their rollers 34 and 35 and by the drive gear 33 to move on the profiled guide rails 8 and 9. FIG. 4 shows a cross-section of the positioning sled 12. The profiled guide roller 35 penetrates by its collar into the longitudinal groove in the profiled guide rail 8 and thereby absorbs axial forces. Radial forces are absorbed by the travel surfaces of the two limit stops at the profiled guide roller 35. The guide rollers 34 are freely supported on the drive shaft 45 of the drive gear 33 and thus shunt the radial forces.

The vertical guidance and the transmission of the drive force to the gear rack 39 which is solidly sunk into the profiled running rail 8 is performed by the drive gear 33. The driving energy is imparted to the drive gear by the pinion 32 mounted in form-locking manner on the same shaft, further by the intermediate gear 31, by the drive pinion 30 and by the drive motor 29. The electrical power is supplied to the electric motor from the current rails 10 which are held by the insulators 48 to the support 11 through the taps 38 which also are mounted by the insulators 48 to the current-tap support 49. The support 11 is welded to the ends of the profiled guide rails 3 of the guide ties 2. The positioning sleds 12 and 13 include a compression roller 36 resting on a shaft butt at their cross-piece 14. When the positioning sleds move away from the guide rails, then the travel rails 1*a* and 1*b l* are pulled by this compression roller 36 out of their original position into the desired new one, the gliding plates 5 perforce being pushed against the limit stops 7. The reversing lever 37 of the positioning sleds 12 and 13 locks or unlocks the closing elements 6 during the course of the positioning sleds 12 and 13.

The travel rails 1*a* and 1*b* are mounted in known manner of rail superstructure engineering on the gliding plates 5. The closing elements 6 are integrated in the gliding plates 5. As shown in FIG. 4, the gliding plate 5 includes a running wheel 41 with a flange. The flange engages underneath the heads of the profiled guide rails 3 of the guide ties 2, whereby vertical lifting forces may be shunted from the gliding plates 5 through the profiled guide rails 3 of the guide ties 2 and into the foundation. Horizontal forces in the longitudinal direction of the travel rails 1*a* and 1*b* are shunted from the gliding plates 5 through the travel surface of the wheel 41, through the profiled guide rails 3 of the guide ties 2 and through the switchplate 42 into the foundation. The gliding plates 5 are provided with the gauge rods 4 which connect them to ensure maintaining the proper track width between the travel rails 1*a* and 1*b* . The limit stops 7 are lined up on the guide ties 2 according to the geometry of the switch, and in such a manner that the limit stops 7 on the side of the travel rail 1*a* correspond to a straight line and the limit stops 7 on the side of the travel rail 1*b* correspond to the geometry of the branch-off. In the locked state of the closing elements 6, the limit stops 7 are connected in form-locking manner with the gliding plates 5.

In order to perform the switching, the lock of the switch forming the main track must be first opened. This unlocking takes place by the positioning sled 12 acting as a positioning element, which moves from the exit region of the switch toward the entry region on the profiled guide rail 8 which is parallel to the travel rails 15 and 16 of the switch (main track), i.e., it moves from b to a, and in the course of its motion unlocks the closing elements 6 mounted to the guide ties 2. After unlocking, the positioning sled 12 remains in its rest position in the entry region of the switch, however outside the track. Only then can the positioning process for moving the main track toward the joining tracks begin. As yet the path of motion of the switch to be moved is null. The crosspiece 14, which is rigidly mounted to the positioning sled 13, now engages by means of the compression roller 36 the inside of the travel edge of the rail head of the travel rail 16 of the main track designed as a switch. Then the positioning sled 13 moves onto the profiled guide rail 9, which is located adjacent the travel rail of the track to be moved (branch-off track), toward the exit region from a to b. In its motion, the positioning sled 13 by means of the crosspiece 14 pulls the travel rails 15 and 16 rigidly mounted to the gliding plates 5 horizontally into the desired position of the joining rails 19 and 20. Simultaneously, the locking of the closing elements 6 fastened to the guide ties is performed by the lever or bail 37 mounted to the positioning sled 13. The track to be moved therefore is fastened into its branched position and secured therein. The switching process is terminated in the exit region. A continuous travel area to the joining rails of the branching track is thus created. The travel rails of the branching track run parallel to the profiled guide rail 9 on which the positioning sled 13 moves. The positioning sled 13 moves on the profiled guide rail 9 so far out of the track that it can create no hazard to traffic by its crosspiece 14.

It will be obvious to those skilled in the art that many modifications may be made within the scope of the present invention without departing from the spirit thereof, and the invention includes all such modifications.

What is claimed is:

1. In an apparatus for moving a railway switch composed of travel rail sections of a main track which are pivoted to rail sections of a branch-off track and locked by closing elements in a particular position with respect to a switch plate extending across the switch, the improvement comprising two positioning sled means, a profiled guide rail means supporting each of said sled means, one of said guide rail means being outside of and parallel to said travel rail sections of said main track, and the other of said guide rail means being outside of and parallel to said rail sections of said branch-off track, and cross-piece means on each positioning sled means, each of said cross-piece means having compression roller means mounted thereon and adapted to engage the inside of a rail head of an adjacent travel rail.

2. An apparatus according to claim 1 including guide tie means supporting said guide rail means and said rail sections.

3. An apparatus according to claim 2 in which said guide tie means includes two parallel, spaced guide rails connected to said switch plate, wheel means between said parallel, spaced guide rails, means connecting said wheel means in form-locking manner with horizontally movable gliding plate means, and means connecting said gliding plate means with said travel rail sections.

4. An apparatus according to claim 2 including closing means on both sides of said gliding plate means, said closing means being pivotal and adapted to be locked into corresponding recesses of said gliding plate means.

5. An apparatus according to claim 4 including means at the underside of said cross-piece means for locking and unlocking said closing means.

6. An apparatus according to claim 1 including drive means on said positioning sled means adapted to engage in recesses in said guide rail means.

7. An apparatus according to claim 6 in which said drive means includes motor means adapted to drive a drive element means in contact with said guide rail means in a form-locking manner.

8. An apparatus according to claim 7 in which said drive element means is a gear.

9. An apparatus according to claim 6 in which said drive means includes electric motor means making contact through a current tap with an electrified rail, and means supporting said electrified rail on guide tie means.

10. In the method of moving a railway switch composed of travel rail sections of a main track which are pivoted to rail sections of a branch-off track and locked by closing elements in a particular position with respect to a switch plate extending across the switch, the improvement comprising pivoting said travel rail sections by means of two positioning sleds, one being adapted to move on a guide rail outside of and parallel to said travel rail sections, and the other on a guide rail outside of and parallel to said rail sections of said branch-off track.

11. A method according to claim 10 in which said positioning sleds close locking devices of said travel rail sections when moving into switching position and open them when returning out of switching position.

* * * * *